US005749816A

United States Patent [19]

Froelich, Sr. et al.

[11] Patent Number: 5,749,816

[45] Date of Patent: May 12, 1998

[54] FLOOR MOUNTABLE AND ADJUSTABLE ROTATING RESISTANCE EXERCISER

[75] Inventors: Thomas E. Froelich, Sr., 2332 12th St., Cuyahoga Falls, Ohio 44223; Jeffrey T. Bertka, Cuyahoga Falls, Ohio

[73] Assignee: Thomas E. Froelich, Sr., Cuyahoga Falls, Ohio

[21] Appl. No.: 801,017

[22] Filed: Feb. 19, 1997

Related U.S. Application Data

[60] Division of Ser. No. 589,559, Jan. 22, 1996, Pat. No. 5,634,871, which is a continuation-in-part of Ser. No. 249,958, May 27, 1994, Pat. No. 5,487,709.

[51] Int. Cl.[6] ..... A63B 21/02

[52] U.S. Cl. ..... 482/123; 482/129; 482/46

[58] Field of Search ..... 482/46, 44, 45, 482/90, 123, 129, 121, 122

[56] References Cited

U.S. PATENT DOCUMENTS

| | | | |
|---|---|---|---|
| 808,528 | 12/1905 | Finney et al. | 482/90 |
| 1,612,796 | 1/1927 | Abraham | 482/90 |
| 4,291,871 | 9/1981 | Lippert | 482/46 |
| 5,522,783 | 6/1996 | Gordon | 482/129 |

*Primary Examiner*—Lynne A. Reichard
*Attorney, Agent, or Firm*—Renner, Kenner, Greive, Bobak, Taylor & Weber

[57] ABSTRACT

An adjustable rotating resistance exerciser wherein an adjustment knob functions to supply an axial force to a series of interleaved washers and compressible washers to adjust the rotational restriction of a tubular grip handle, which is disposed on an inner collar that is affixed to a tubular handlebar. The exerciser may be configured such that it is adaptable to a riding bicycle or a stationary exercise bicycle or the exerciser may be affixed to various size tubes or bars such that it may be used in any convenient location. A further embodiment of the present invention may be utilized by incorporating the adjustable rotating resistance exerciser with a tabletop unit which can be used by individuals confined to wheelchairs, hospital beds or nursing homes. Furthermore, the tabletop unit may be modified to accept foot plates so that individuals may use the rotational exerciser to exercise ankle and calf muscles. Additionally, the tabletop unit is configured such that it is lightweight, portable and may be easily disassembled for convenient storage. Yet another embodiment provides a floor mounted base that telescopically receives a flexible member which telescopically receives the adjustable rotating resistance exerciser. Still another embodiment provides adjustable rotating resistance exercisers telescopically received and secured to both ends of a flexible member. Another embodiment provides an adjustable rotating exerciser received by a mounting member such as a baseball bat, golf club, tennis racket or the like.

8 Claims, 6 Drawing Sheets

FLOOR MOUNTABLE AND ADJUSTABLE ROTATING RESISTANCE EXERCISER

CROSS REFERENCE TO RELATED APPLICATION

This application is a division of application Ser. No. 08/589,559, filed Jan. 22, 1996, now U.S. Pat. No. 5,634,871 which is a continuation-in-part of application Ser. No. 08/249,958 filed May 27, 1994, now U.S. Pat. No. 5,487,709 for ADJUSTABLE ROTATING RESISTANCE EXERCISER.

TECHNICAL FIELD

The invention herein resides generally in the art of adjustable resistance exercise equipment. More particularly, the invention relates to a table top exercise unit with adjustable rotating resistive handle grips. Specifically, the invention relates to a table top exercise unit with adjustable resistive rotating grips adaptable to variations which include utilizing a hand brake in conjunction therewith, a bicep/tricep exerciser in conjunction therewith, and a foot pedal attached thereto. The invention also provides attaching the adjustable rotating resistance exerciser to a flexible member.

BACKGROUND ART

In the last fifty years, the general populace has increasingly recognized the need and importance of physical fitness. This need has arisen because of studies done by the medical community showing the importance of a balanced diet and moderate exercise. However, due to the increasingly sedentary lifestyle of the population, numerous home exercise devices have been developed. These devices include, but are not limited to, stationary bicycles, free weights and resistance weight machines that use specially designed rubber bands or pneumatic tubes.

In particular, various devices and exercisers have been developed to strengthen the hand, wrist, and forearm muscles. For example, dumbbells or free weights have been used to perform a wrist curl type exercise. A wrist curl is performed by holding a dumbbell in the palm of the hand with the fingers and thumb holding the weight therein. The dumbbell is first held with the palm of the hand towards the bicep muscle, the hand is then slowly relaxed letting the dumbbell roll down the fingers until the weight is supported by just the tips of the fingers. The weight is then slowly pulled back toward the bicep muscle by reclenching the fingers toward the palm of the hand. Another exercise device is the hand held wrist spring. This mechanism is used by placing the thumb on one of the ends of the spring and the tips of the fingers on the other and then drawing the thumb and the fingers together. Specialized rubber band type devices may also be used, whereby a person will hold each end of the rubber band in a receptive hand and then proceed to stretch and relax the rubber band in numerous repetitions. As muscles in the forearms develop, a higher resistance rubber band may be used to increase one's strength. It is also well known that squeezing a tennis ball or other similar type rubber ball will strengthen the hand and forearm muscles.

Unfortunately, use of the aforementioned exercise devices has several drawbacks. One problem is that once a person has exercised long enough with the aforementioned weight, spring, or rubber band device, that device will no longer be used as an increased resistance or heavier weight is required to further develop the subject muscle area. Another disadvantage is that these devices are not readily compatible with other exercise equipment nor are they portable.

While the use of the exercise devices to strengthen muscles is well known, it is also known that the flexing or stretching of muscles prior to activities requiring those muscles can lead to the most effective use of the muscles and prevention of injury thereto. Specifically, it has been found that persons using keyboards, sewing machines, or other devices requiring prolonged usage of the hands and arms in a rotated position are given to development of carpal tunnel syndrome. However, the risk of developing such a malady is significantly reduced when the arm and wrist muscles are flexed and exercised prior to the damaging activity. However, there is no known exercise device available for exercising the arm and wrist for such purpose.

Therefore, there is a need for a low impact resistance type exercise device adaptable with other exercise equipment that is easily adjustable to exercise the hand, wrist, and forearm muscles in addition to the muscles of the upper arm and upper back. There is also a need in the art for an exercise device adaptable to exercise the ankle and foot muscles. There is a further need for a simple and effective device as aforesaid which permits flexure of the wrist and forearm prior to engagement in keyboard-type activities. Furthermore, there is a need to provide such an exercise device that is adaptable in all its variations for use with coin operative mechanisms.

DISCLOSURE OF INVENTION

In light of the foregoing, it is a first aspect of the present invention to provide an adjustable resistance rotational exercise device.

Another aspect of the invention is to provide an adjustable resistance rotational exercise device that may be affixed to different types of tubes or bars of other exercise devices or stationary fixtures.

Still a further aspect of the present invention is to provide an adjustable resistance rotational exercise device that may be used on a riding bicycle or a stationary exercise bicycle.

An additional aspect of the present invention is to provide an adjustable resistance rotational exercise device that may be used on a tabletop base so that the device may be used on recreational vehicles or boats and is readily accessible, even by those confined to wheelchairs or hospital beds, or may be placed on the floor and modified to exercise the foot and ankle muscles.

Still another aspect of the present invention is to provide an adjustable resistance rotational exercise device mounted to one end of a flexible member, the opposite end of which is mounted to a fixed reference.

Yet another aspect of the present invention is to provide an adjustable resistance rotational exercise device that is mounted to both ends of a flexible member.

Yet an additional aspect of the invention is to provide an adjustable resistance rotational exercise device with a bar to exercise the bicep and tricep muscles, the bar having a flexible knuckle therein with its own individual resistance levels or by attaching directly to the bar flexible rubber bands or pneumatic tubes.

A further aspect of the invention is to provide an adjustable resistance rotational exercise device adaptable to be received on a sporting implement such as a baseball bat, golf club, tennis racket or the like.

The foregoing and other aspects of the invention which shall become apparent as the detailed description proceeds are achieved by an adjustable rotating resistance exerciser, comprising: a rotatable collar adaptable to receive a mounting member; a shaft extending axially from the mounting member; means for generating resistance disposed on the shaft and positioned between the mounting member and the rotatable collar; and means for adjusting the means for generating resistance, wherein the means for adjusting is mounted to the mounting member to control the rotational movement of said rotatable collar.

The present invention also provides a floor mounted resistance exerciser, comprising; a base mountable to a floor; a tubular support member extending outwardly from the base; a rotating resistance exerciser; and a flexible member telescopically received and selectively secured at one end to the tubular support member and telescopically received and selectively secured at the opposite end to the rotating resistance exerciser, wherein the rotating resistance exerciser rotates around the flexible member.

The present invention also provides an arm exerciser, comprising: a flexible member having first and second ends; and a rotating resistance exerciser telescopically disposed on each of the first and second ends, each of the rotating resistance exercisers having an inner collar slidingly received by the flexible member, a shaft having internal threads, the shaft extending axially from the inner collar, means for generating resistance disposed on the shaft, a tubular grip handle disposed over the means for generating resistance and the inner collar, wherein the tubular grip handle rotates around the inner collar, and means for adjusting the means for generating resistance, wherein the means for adjusting is rotatably mounted to the inner collar.

BEST MODE FOR CARRYING OUT THE INVENTION

Figures 1, 2, 3, 4, 5:
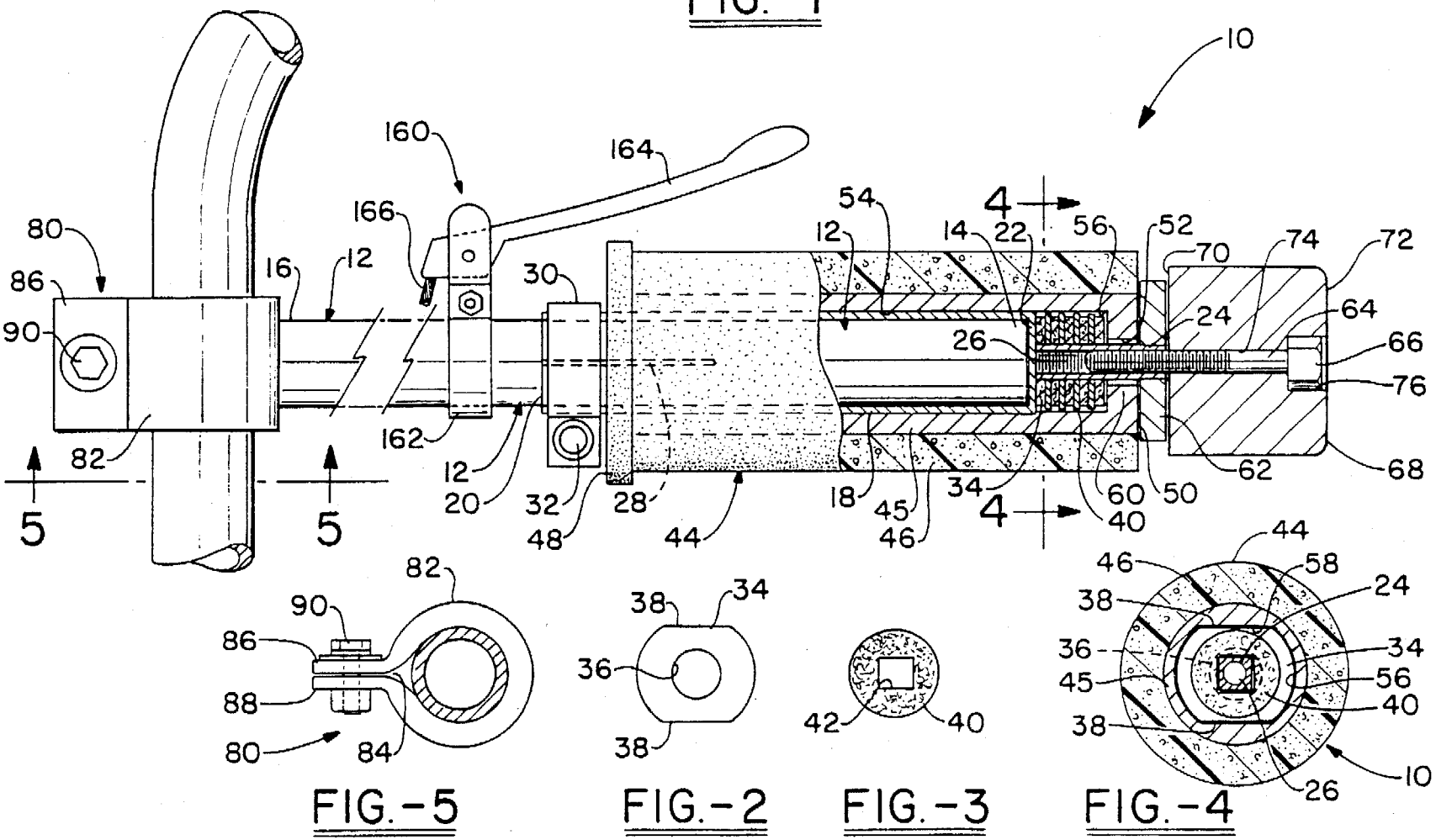
FIG. 1 is a partial sectional view showing an adjustable rotating resistance exerciser mechanism on a handlebar with an optional hand brake device located in close proximity therewith and a variable clamp device at the opposite end of the handlebar.
FIG. 2 is a plan view of a double D washer utilized to adjust the rotational resistance value of the present invention.
FIG. 3 is a plan view of a compressible washer utilized to adjust the rotational resistance valve of the present invention.
FIG. 4 is an end view, in cross-section as taken along line 4—4 of FIG. 1, showing double D washers and compressible washers in a working interrelationship with an internally threaded square shaft, which is affixed to the handlebar.
FIG. 5 is a cross-sectional view taken along the line 5—5 of FIG. 1 showing how a handlebar of the present invention is (or may be) clamped to an unrelated device.

Referring now to the drawings and more particularly to FIG. 1, it can be seen that an adjustable rotating resistance exerciser according to the invention is designated generally by the numeral 10. The exerciser 10 is adaptable to receive a handlebar or mounting member 12 which, in the preferred embodiment, is a hollow metal tube with an adjustment end 14 opposite a fixed end 16. Disposed around the adjustment end 14 is an inner collar 18, which has an open end 20 opposite a closed end 22. As can be seen in FIG. 1, the closed end 22 of the inner collar 18 covers the adjustment end 14 of the handlebar 12. A square shaft 24, integral with the closed end 22, extends outwardly therefrom and is concentrically aligned therewith, and has disposed therein internal threads 26. The open end 20 of the inner collar 18 has at least two clamping cuts 28 lengthwise therewith which are diametrically opposed to each other. Disposed around the open end 20 of the inner collar 18 is a clamp 30. A clamp screw 32 is used to close the clamp 30 onto the inner collar 18, thereby compressing the inner collar at the area of the clamp cuts 28, so as to securely fasten the inner collar to the handlebar 12.

FIG. 2 shows a double D washer 34 which has a washer hole 36 centrally therein, the diameter of the hole 36 being large enough to freely rotate about the square shaft 24. In other words, the diameter of the hole 36 exceeds the length of a diagonal line interconnecting opposed corners of the square shaft 24. The double D washer 34 also has at least two flat portions 38 on the perimeter thereof and which are parallel to each other.

FIG. 3 shows a compression washer 40 which has a square hole 42 centrally therein. The square hole 42 is large enough to be disposed upon the square shaft 24, without being freely rotatable thereon. Furthermore, it will be appreciated hereinafter that the outer diameter of the compressible washer 40 is less than the distance between the parallel flat portions 38, of the double D washer 34.

Referring again to FIG. 1, those skilled in the art will appreciate that the double D washers 34 and the compression washers 40 are alternatingly interleaved on the square shaft 24. In the preferred embodiment, it should be appreciated that the double D washers 34 are made out of metal, and that the compression washers 40 are of a compressible fibrous material such as garlock.

A tubular grip handle 44 is disposed over the inner collar 18 and the plurality of interleaved double D washers 34 and compression washers 40. Preferably, the grip 44 has a rigid inner surface 45, either metal or plastic and a foam outer surface 46. The tubular grip handle 44 further includes an open end 48 adjacent the clamp 30, opposite a knob end 50 that surrounds the interleaved washers 34 and 40. The knob end 50 has a shaft hole 52 which is disposed over the square shaft 24 and is concentrically aligned therewith. The inner surface 45 has an interior portion 54 which slidingly bears upon and rotates around the inner collar 18. At the knob end 50, and integral with the interior portion 54, is an interior portion 56 surrounding the washers 34, 40. As can be seen in FIG. 4, the interior portion 56 has a diameter slightly larger than the major diameter of the double D washer 34. It should also be appreciated that the diameter of the interior portion 56 is larger than the diameter of the compressible washer 40. Within the interior portion 56 are at least two parallel flat sections 58 which interrupt the otherwise cylindrical surface of the portion 56. The flat sections 58 correspond to, but are separated by a distance slightly greater than the distance between the parallel double D washer flats 38. Thus, as the tubular grip handle 44 is rotated, the flat sections 58 engage the flats 38 and force the double D washers 34 to rotate in a similar manner about the square shaft 24. In other words, the washers 34 are effectively keyed to and are rotatable with the grip 44.

Referring again to FIG. 1, a handle lip 60 at the knob end 50 serves to hold the interleaved double D washers 38 and compressible washers 40 on the square shaft 24. A knob washer 62 is fittingly disposed on the square shaft and abuts the knob end 50 of the tubular grip handle 44. An adjustment screw 64, which has a screw bead 66, fastenably secures an adjustment knob 68 to the square shaft 24. The adjustment knob 68 has a washer side 70, which abuts the knob washer 62, and an opposite outer side 72. The adjustment knob 68 has a screw hole 74 which supports the adjustment screw 64, there being integral therewith a bore 76 for securely holding the screw head 66. The screw head 66 is press-fit into the bore hole 76 such that as the adjustment knob 68 is turned the adjustment screw 64 is rotated in a similar fashion.

With continued reference to FIG. 1, the operational features of the adjustable rotating resistance exerciser 10 will now be explained. An individual desiring to use the exerciser 10 will place a hand upon the foam outer surface 46 of the tubular grip handle 44 and reciprocatingly rotate the handle to exercise the forearm muscles, wrist, and the muscles within the hand. If the individual determines that the exerciser 10 is too loose or rotates too freely, he or she may then rotate the adjustment knob 68 in a clockwise direction. As the adjustment knob 68 is rotated, the adjustment screw 64, which is integral with the adjustment knob 68 at the bore 76, functions to pull the adjustment knob into the internal threads 26 of the square shaft 24. This results in the adjustment knob 68 applying an axial force to the knob washer 62, which correspondingly transmits an axial force to the handle lip 60, which transmits an axial force to the plurality of interleaved double D washers 34 and compression washers 40. Therefore, as those skilled in the art will appreciate, as the tubular grip handle 44 is rotated the flat section 58 will correspondingly engage and rotate the double D washers 34. As a result, since the square holes 42 of the compression washers 40 key the washers to the square shaft 24, the compression washers 40 are prevented from rotation about the square shaft 24, thus the axial force applied by the adjustment knob 68 serves to create a frictional force between the interleaved compressible washers 40 and the rotating double D washers 34. Accordingly, by rotating the adjustment knob 68, varying levels of rotational resistance can be set for the exerciser 10. It should further be appreciated that the knob washer 62, which is rotatable about the square shaft 24, prevents the rotation of the grip handle 44 from changing the resistance level set by the adjustment knob 68. Those skilled in the art will appreciate that the alternatingly interleaved washers 34, 40, in combination with the adjustment knob 68, serve as an adjustment brake providing the resistive force for the exerciser 10.

As seen in FIG. 1 and further illustrated in FIG. 5, an adapter clamp 80, which is integral with the handlebar 12, is utilized to affix the adjustable rotating resistance exerciser 10 to various size tubes and bars. The adapter clamp 80 has a clamp hoop 82 that is integral with the handle bar 12. A hoop split 84 divides the clamp hoop 82 into a head protrusion 86 which is opposite a thread protrusion 88. A clamp screw 90 interconnects the head protrusion 86 to the thread protrusion 88, thereby providing for adjustment of the tightness of the clamp hoop 82 onto the desired tube or bar. Those skilled in the art will appreciate that the adjustable rotating resistance exerciser 10 can be easily adapted for use with a riding bicycle, stationary exercise bicycle, or on any number of exercise devices.

Figure 7:
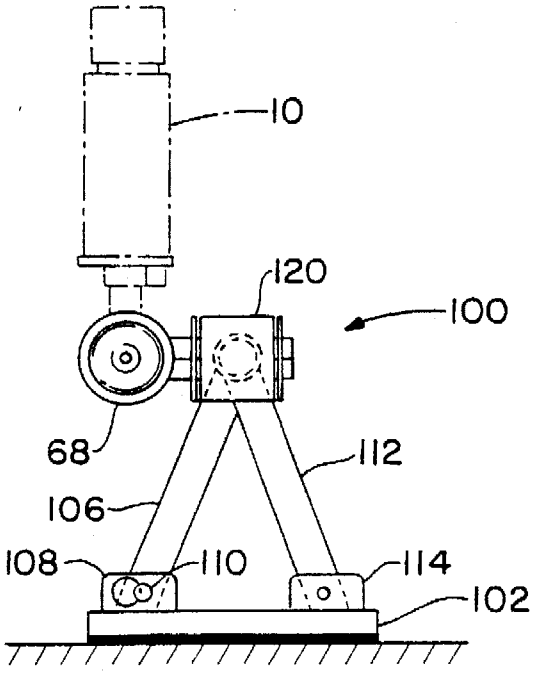
FIG. 7 is a side elevational view of the tabletop exercise unit shown in FIG. 6.
Figure 6:
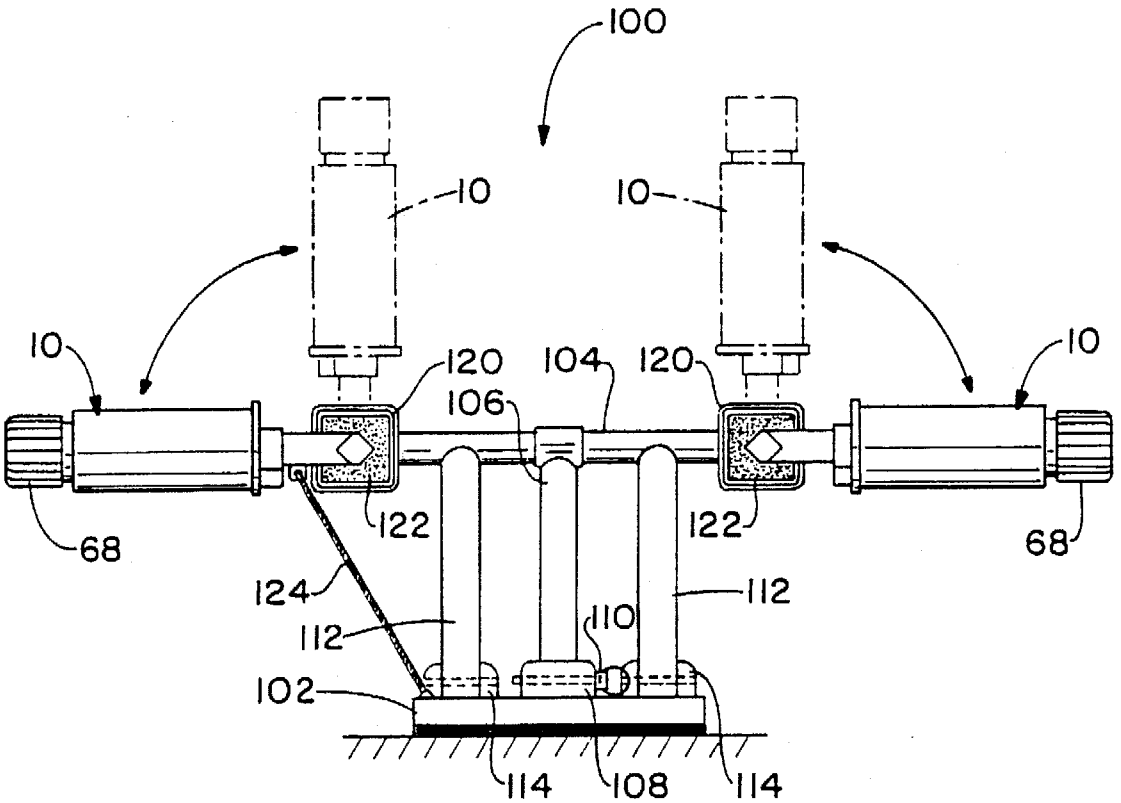
FIG. 6 is a front elevational view of a tabletop exercise unit utilizing an adjustable resistance rotational mechanism of the present invention.

Referring now to FIG. 6, the exerciser 10 may be used in conjunction with a tabletop unit 100, which has a non-skid base 102 from which upwardly extends a center leg 106. The center leg 106 is integral with or rotatably mounted to a handlebar 104 which has disposed on each end an adjustable rotating resistance exerciser 10. A detachable coupler 108 is integral with the base 102, so as to pivotally connect the center leg 106 therein. A removable pin 110 is used to interconnect the center leg 106 to the detachable coupler 108. At least two pivot legs 112 extend downwardly from the handlebar 104 to pivot mounts 114, so as to rotatably affix the pivot legs 112 to the base 102. Typically, the pivot mounts 114 will be in a position offset from the detachable coupler 108 as shown in FIG. 7.

In a further embodiment illustrated in FIG. 6, a knuckle system 120 is incorporated into the handlebar 104. The knuckle system 120 allows the rotating resistance exerciser 10 to be pivotally extended upward to a perpendicular position with respect to the handlebar 104, thereby allowing exercising of the bicep, tricep, upper arm, shoulder and back muscles. The knuckle system 120 also allows the simultaneous use of the rotation exerciser 10, thereby providing an exercise device that works all the muscles of the wrist, hand and arm. Various size rubber inserts 122 having a range of resistive values are provided for placement within the knuckle 120 to allow a person to adjust the device depending upon their strength. The resistive values of the inserts 122 will typically be characterized by the durometer of the rubber from which the inserts are made. If desired, the mechanism of the resistance exerciser 10 could be employed in place of the rubber inserts. A further variation of this embodiment provides that flexible rubber bands 124 or other suitable types of resistance may be affixed between the base 102 and the handlebar 104 to provide the desired resistance levels.

Figure 9:
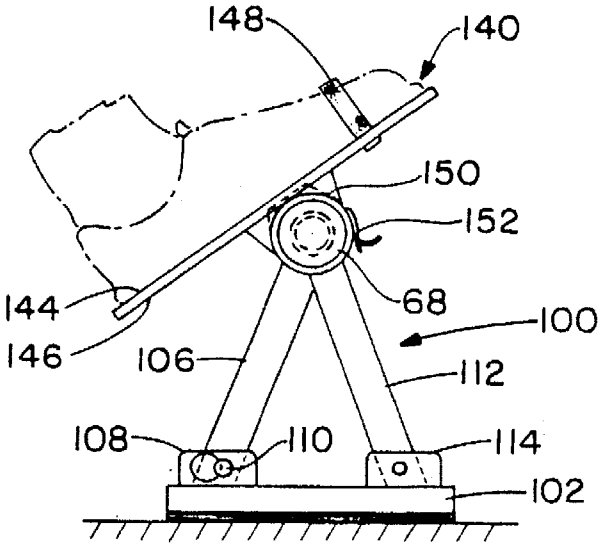
FIG. 9 is a side elevational view of the tabletop exercise unit shown in FIG. 8.
Figure 8:
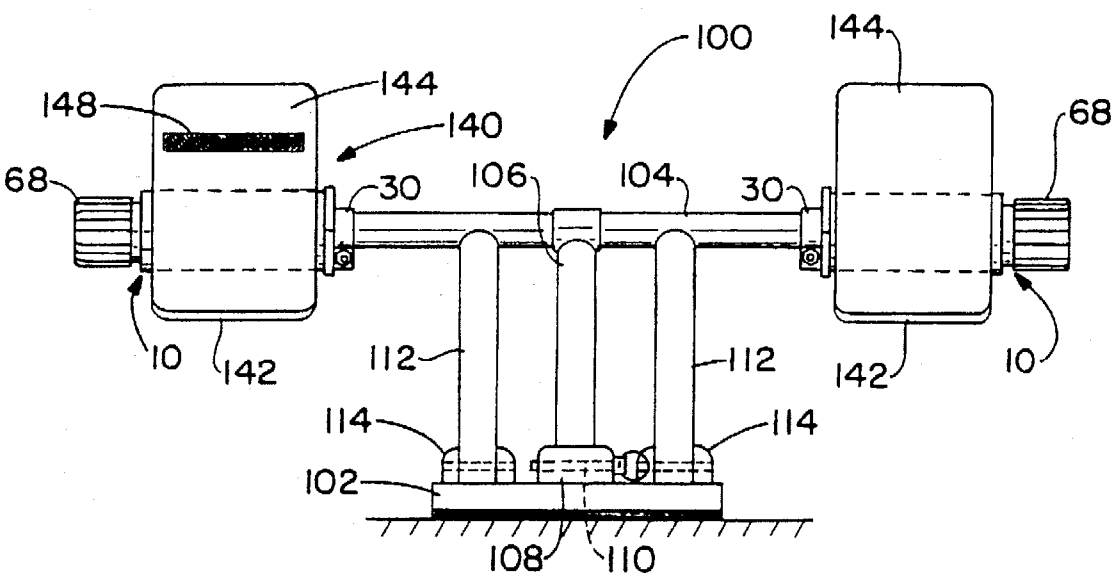
FIG. 8 is a front elevational view of the tabletop exercise unit with foot pedals attached to the adjustable resistance rotational mechanism.

Referring now to FIG. 8, it can be seen that the tabletop unit 100 can also be modified to create a foot pedal exerciser 140. The foot pedal exerciser 140 includes a foot plate 142, which has a foot side 144 opposite a grip side 146. A toe restraint 148 is incorporated into the foot side 144 so that an individual may hold his or her foot on the foot plate 142 while performing the exercise. As seen in FIG. 9, handle side 146 has mounted thereto a foot clamp 150 which has a clamp latch 152 that is mounted upon the tubular grip handle 44 of the adjustable rotating resistance exerciser 10. Here, the user can exercise his calf and ankle in much the same fashion as he would his wrist and forearm.

Referring back to FIG. 1, it can be seen that the exerciser 10 may be used upon the actual handle bars of a bicycle. In such a case, a hand brake 160 would typically be located in close proximity to the exerciser 10. The hand brake 160 includes a mount 162 which is affixed to the handlebar 12. Extending upwardly and outwardly from the mount 162 is a hand lever 164 which, in standard fashion, in interconnected by a cable 166 to a caliper. Therefore, as a person utilizes his bicycle, the rotational exerciser 10 may also be simultaneously used.

As can be seen in FIG. 1 and FIG. 5, the resistance exerciser 10 may be mounted upon various size tubes or bars for easy interchange by the person utilizing the equipment. Another use of the exerciser 10 is with a table top unit as illustrated in FIGS. 6 and 7. The tabletop unit 100 allows the exercisers 10 to be used by individuals who are confined to wheelchairs, hospital beds or nursing homes. As part of a physical therapy program, the physical therapist may set the resistance levels of the exerciser 10 to achieve a certain fitness goal. It should also be appreciated that the foam handle 46 allows an individual to squeeze the handle while simultaneously rotating the handle, thereby further exercising muscles within the hand.

It should also be appreciated that the tabletop unit 100 can be disassembled or folded down for easy storage. By removing the pin 110, the center leg 106 may be removed from the detachable coupler 108. The legs 106, 112 may then be straightened or folded onto each other while handlebar 104 pivots downwardly about the pivot mount 114 to lie upon the base 102. In such a flat posture, the tabletop unit 100 can be stored within a cabinet or underneath a bed.

Figure 10:
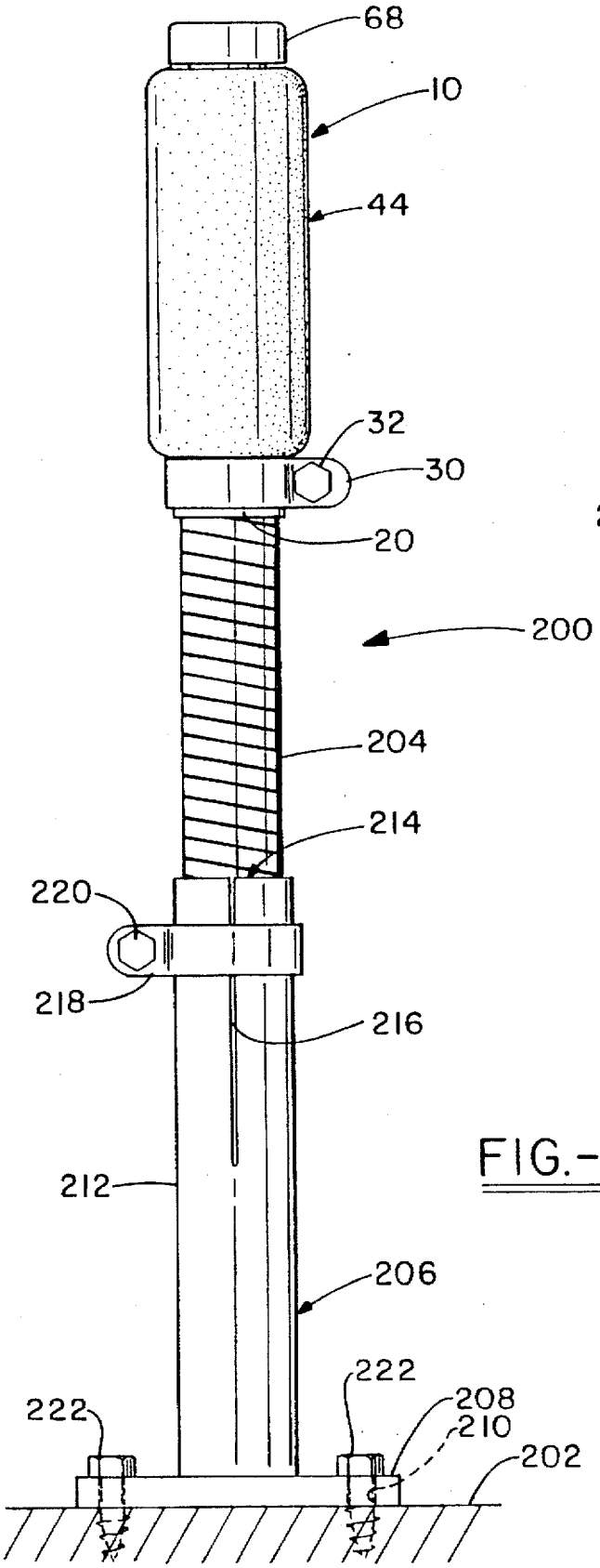
FIG. 10 is a front elevational view of a floor mounted exerciser.

Referring now to FIG. 10, it can be seen that a floor mounted exerciser according to the invention is designated generally by the numeral 200. The floor mounted exerciser 200 includes an adjustable rotating resistance exerciser 10, as described above, mounted to a floor or other similar stationary member 202, such as a ceiling, a wall or the like. A flexible member 204 is telescopically received and selectively secured at one end to the adjustable rotating resistance exerciser 10 and telescopically received and selectively secured at the opposite end to a mounting member 206 that is secured to the floor 202.

In particular, the mounting member 206 includes a base 208 with a plurality of holes 210. Outwardly extending from the base 208 is a tubular support member 212 which has an inner diameter large enough to slidingly receive the flexible member 204. The tubular support member 212 has an open end 214 opposite the end that extends from the base 208. The tubular support member 212 also has a slit 216 extending from the open end 214 toward the base 208. A support member clamp 218 is disposed around the tubular support member 212, wherein the support member clamp 218 is tightened by a set screw 220. Those skilled in the art will appreciate that as the set screw 220 is tightened, the slit 216 is closed reducing the inner diameter of the tubular support member 212 and securing the tubular support member 212 around the flexible member 204. Of course, the support member clamp 218 and set screw 220 could be replaced by any means for tightening or detachably securing the tubular support member 212 to the flexible member 204. The base 208 is secured to the floor 202 by fasteners 222 such as screws, nails or the like.

It will be appreciated that the flexible member 204 is a chrome-plated steel spring with an outer diameter receivable by both the tubular support member 212 and the adjustable rotating resistance exerciser 10. Of course, the flexible member 204 could be any material that can withstand repeated flexures. The structure of the floor mounted exerciser 200 is such that the flexible member 204 can be positionally adjusted within the rotating resistance exerciser 10 and the tubular support member 212. As such, a person using the device 200 can adjust the stiffness of the flexible member 204 accordingly. In other words, by lengthening the extent of the flexible member 204 maintained between the tubular support member 212 and the adjustable rotating resistance exerciser 10, the resistance or force required to move the flexible member is reduced. Conversely, the closer the adjustable rotating resistance exerciser 10 is moved toward the tubular support member 212, the greater the resistance of the flexible member 204.

The floor mounted exerciser 200 allows the user thereof to situate the device in any desired fashion. It is envisioned that the floor mounted exerciser 200 can be secured to the floor or ceiling of the cab of a tractor trailer or other vehicle or in a position accessible to individuals required to stay in one place for extended periods of time. As such, these individuals can exercise their hand, wrist, arm and associated muscles while seated. As such, individuals using the exerciser 200 can relieve palsy or other ailments caused by gripping an implement such as a steering wheel for extended periods of time. It should also be appreciated that the floor mounted exerciser 200 could be mounted to a wall or platform in such a manner that a bedridden patient or other person undergoing physical therapy could use the device. The exerciser 200 could also be adapted to be suspended from the ceiling in an inverted "T-bar" configuration. In this embodiment, exercisers 10 are mounted to both ends of the "T" for access by bedridden patients.

Figure 10A:
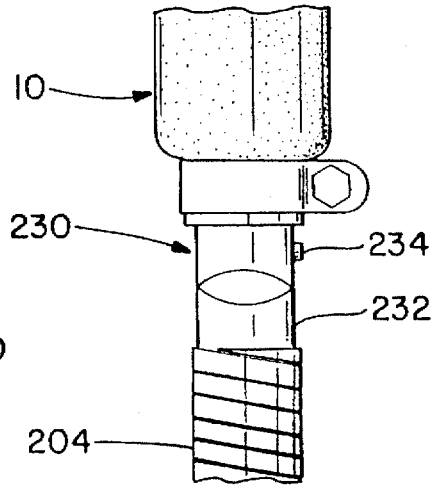
FIG. 10A is a front elevational view of a floor mounted exerciser with a knuckle.

Yet another embodiment is shown in FIG. 10A where a knuckle system is designated generally by the numeral 230. The knuckle system 230 is interposed between the exerciser 10 and the flexible member 204. A knuckle tube 232 extends from the flexible member 204 and is received at its opposite end by the exerciser 10. A spring biased pushbutton or release mechanism 234 extends from the knuckle tube 232. By depressing the pushbutton 234, the knuckle tube 232 is pivotable to an angled position. In other words, the resistance exerciser 10 can be positioned and held in place at any angle increment between 0 and 90 degrees with respect to the flexible member 204. Because the flexible member 204 is rotatably positionable within the tubular support member 212, it will be appreciated that a multitude of positions are attainable when the knuckle system 230 is used in conjunction with the floor mounted exerciser 200.

Figure 11:
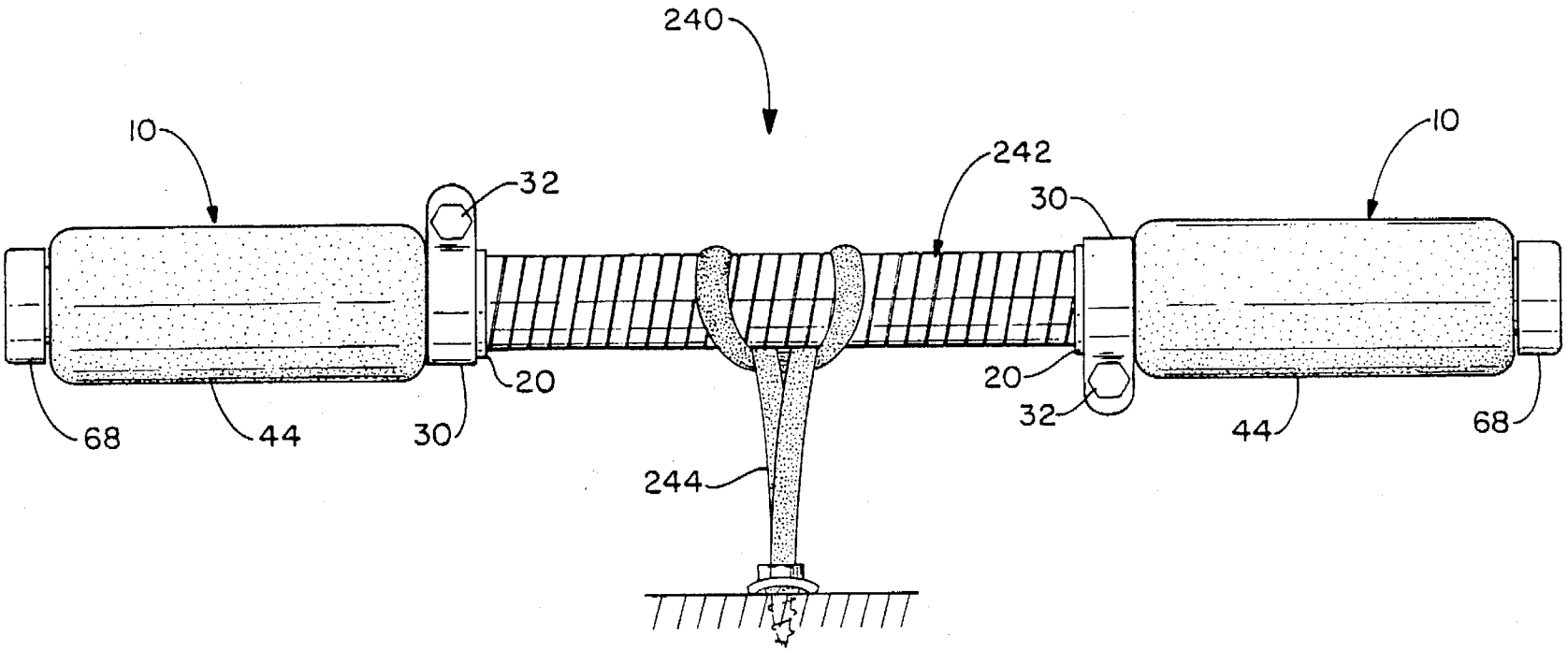
FIG. 11 is a front elevational view of an arm exerciser.

Yet another type of exercise device employing the adjustable rotating resistance exerciser 10 is shown in FIG. 11. In particular, it can be seen that an arm or "bullworker" type exerciser according to another embodiment of the invention is designated generally by the numeral 240. The arm exerciser 240 includes the flexible member 242 with adjustable rotating resistance exercisers 10 disposed on both ends. The adjustable rotating resistance exercisers 10 are telescopically disposed on both ends of the flexible member 242, wherein each of the rotating resistance exercisers 10 are slidingly received and secured thereto. As discussed previously, the amount of resistance generated by the arm exerciser 240 is directly related to the length of the flexible member 242 exposed. Thus it will be appreciated as the resistance exercisers 10 are moved closer to one another, the resistance of the flexible member 242 is greatly increased. Conversely, as the rotatable resistance exercisers 10 are moved away from one another, the amount of resistance of the arm exerciser 240 is reduced. Thus, it will be appreciated that as the individual rotates the grips 44 on the adjustable rotating resistance exercisers 10, they can also use their upper arm and chest muscles to bend the flexible member 242 as desired.

If desired, an additional restraint of motion can be employed with the arm exerciser 240 by securing an elastic band 244 to the relative midpoint of the flexible member 242 and securing the opposite end of the elastic band 244 to a stationary member 246 such as a floor or relatively large immovable object. This allows the user of the device to exercise additional muscle groups within the arms and upper chest.

Figure 12:
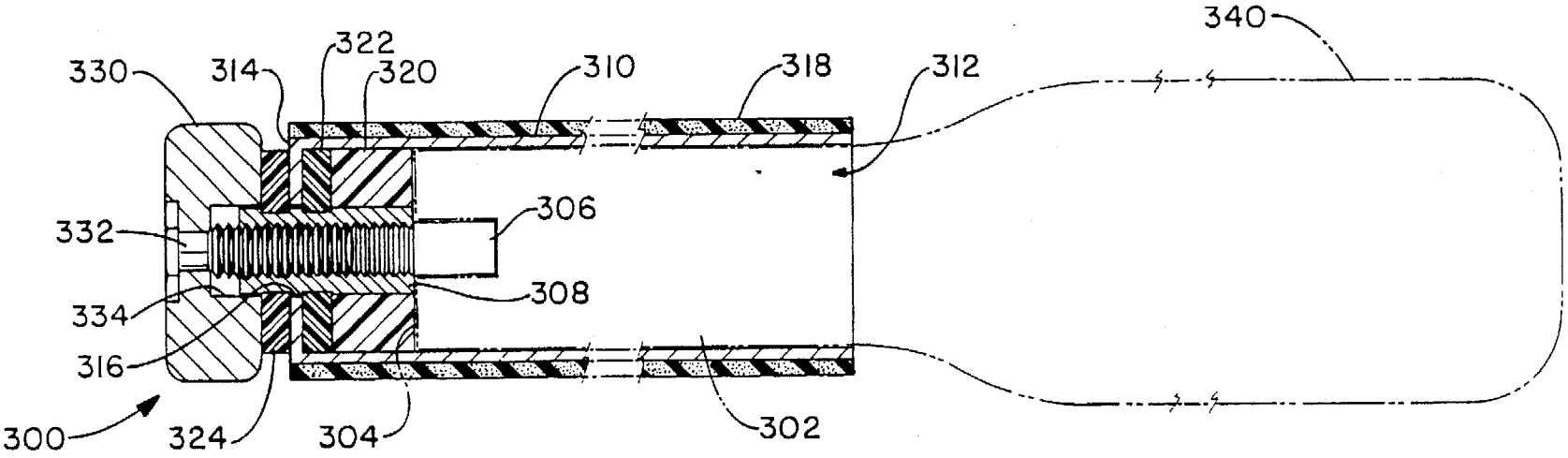
FIG. 12 is a partial sectional view of an adjustable rotating resistance exerciser mechanism on a mounting member such as a bat.

Referring now to FIG. 12, it can be seen that an adjustable rotating resistance exerciser according to the invention is designated generally by the numeral 300. The exerciser 300 is received upon a mounting member 302, which is typically a handle of a sporting implement, such as a baseball bat, golf club, tennis racket or the like. The mounting member 302 has a mounting end 304 at the end opposite the sporting implement. A stud 306 is received in the mounting end 304 and secured thereto. It will be appreciated that the stud 306 can be threadingly received by, welded to or affixed to the mounting member 302 in any manner known in the art. An internally threaded shaft 308 extends axially from the stud 306 and the mounting member 302 in a direction opposite the sporting implement. It will be appreciated that the exterior surface of the shaft 308 could be hexagonal, square, or non-circular in shape.

A rotatable collar 310, which is generally tubular in shape and of metal or plastic construction, is adaptable to be slidably received upon the mounting member 302. The rotatable collar 310 has an open end 312 which is inserted onto the mounting member 302. Opposite the open end 312, the rotatable collar 310 has a lip 314 with a shaft hole 316 therethrough. The shaft hole 316 fits and rotates around the shaft 308. A tubular grip handle 318, which is typically made of foam rubber or other similar polymeric material is disposed around and secured to the rotatable collar 310.

Disposed on the shaft 308 is a compression washer 320 and a washer 322, both of which are positioned between the mounting member 302 and the rotatable collar 310. The compression washer 320 is made of a polymeric material and is rotatable about the shaft 308. The washer 322 is keyed or fixed to the shaft 308 and as such does not rotate thereabout. The washer 322 is typically made of a compressible fibrous material such as garlock or a compressible polymeric material such as phenol. Although only one compression washer 320 and one phenolic washer 322 are shown disposed between the mounting end 304 and the lip 314, it will be appreciated that a plurality of each type of washers may be interleaved and disposed on the shaft 308 as desired.

A knob washer 324 is disposed on the shaft 308 and bears on the exterior surface of the lip 314. The knob washer 324, which is typically made of the same material as the washer 322, is keyed to the shaft 308. An adjustment knob 330, which bears against the knob washer 324, has a threaded rod 322 extending axially therefrom and which is received by the internally threaded shaft 308. The adjustment knob 330 also has a bore 334 to allow for clearance around the shaft 308.

Figure 12A:
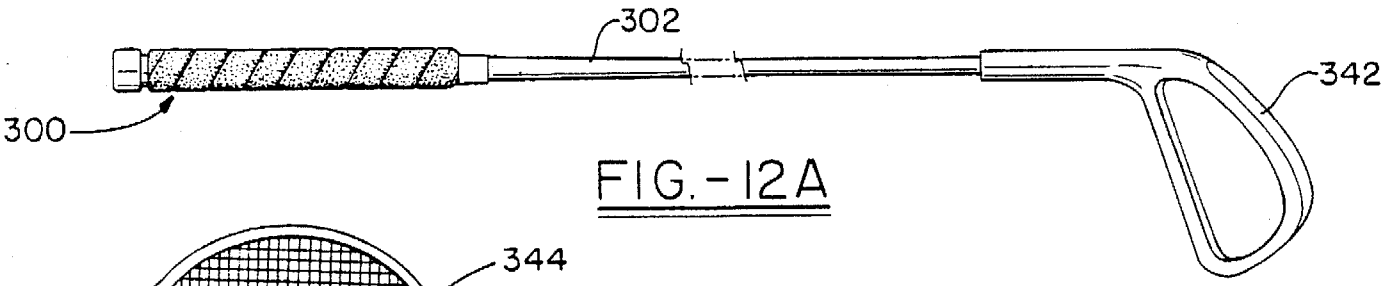
FIG. 12A is a partial view of a mounting member such as a golf club.
Figure 12B:
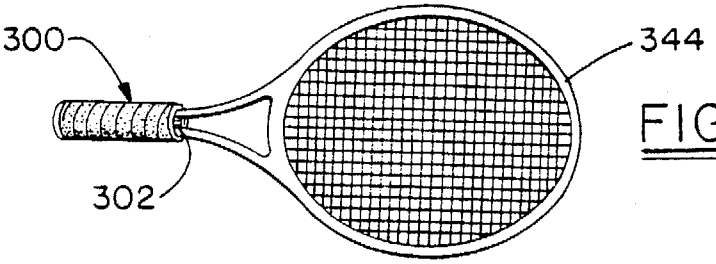
FIG. 12B is a partial view of a mounting member such as a tennis racket.

As seen in FIG. 12, the opposite end of the mounting member 302 could be a baseball bat 340. FIG. 12A presents an exerciser 300 mounted to an implement such as a golf club 342, while FIG. 12B presents an exerciser 300 mounted to a sporting implement such as a tennis racket 344.

In a manner similar to that presented for the exerciser 10 presented in FIGS. 1–5, the adjustable rotating resistance exerciser 300 provides an adjustable resistance exercising device that can be incorporated into any sporting implement with a handle. In particular, the person using the exerciser 300 rotates the adjustment knob 330 for the purpose of increasing or decreasing the amount of resistance required to rotate the grip 318 and collar 310 around the mounting member 302. As the adjustment knob 330 is rotated, the threaded rod 332, which is integral therewith, engages the internal threads of the shaft 308. As such, the adjustment knob 330 applies an axial force to the knob washer 324, which correspondingly transmits an axial force to the lip 314, which transmits an axial force to the washer 322, the compression washer 320 and the mounting end 304. Therefore, as the grip 318 is rotated, the washer 320 freely rotates about the shaft 308 while the washer 322 remains fixed, thus the axial force applied by the adjustment knob 330 serves to create a frictional force between the knob washer 324, the lip 314 and the washer 322. Accordingly, by rotating the adjustment knob 330, varying levels of rotational resistance can be set for the exerciser 300. Those skilled in the art will appreciate that the interleaved washers 320 and 322, in combination with the adjustment knob 330, serve as an adjustment brake providing the resistive force for the exerciser 300.

Based upon the foregoing embodiments, it will be appreciated that the floor mounted exerciser, the exerciser with the knuckle system and the bullworker exerciser provide unique exercisers by virtue of the adjustable rotating resistance mechanism disclosed. Further advantages of the adjustable rotating resistance exerciser is that it is adaptable to any mounting member such as a baseball bat, a tennis racket, a golf club, any other sporting equipment or the like.

Thus it can be seen that the objects of the invention have been satisfied by the structure presented above. It should be apparent to those skilled in the art that the objects of the present invention could be practiced by any person of varying physical ability.

While various embodiments of the invention have been presented and described in detail, it will be understood that the invention is not limited thereto or thereby. Accordingly, for an appreciation of the true scope and breadth of the invention, reference should be made to the following claims.

What is claimed is:

1. A floor mounted resistance exerciser, comprising:

a base mountable to a floor;

a tubular support member extending outwardly from said base;

a rotating resistance exerciser; and a flexible member telescopically received and selectively secured at one end to said tubular support member and telescopically received and selectively secured at the opposite end to said rotating exerciser, wherein said rotating resistance exerciser rotates around said flexible member which is flexible transversely with respect to said tubular support member.

2. The floor mounted resistance exerciser according to claim 1, wherein said rotating resistance exerciser comprises:

an inner collar telescopically receiving said flexible member;

a shaft having internal threads, said shaft extending axially from said inner collar;

means for generating resistance disposed on said shaft;

a tubular grip handle disposed over said means for generating resistance and said inner collar, wherein said tubular grip handle rotates around said inner collar; and means for adjusting said means for generating resistance, wherein said means for adjusting is rotatably mounted to said inner collar.

3. The floor mounted resistance exerciser according to claim 2, wherein said tubular support member has a slit at the end opposite said base, said tubular support member having a support member clamp to close said slit and secure said tubular support member around said flexible member.

4. The floor mounted resistance exerciser, according to claim 3, further comprising:

a clamp integral with said inner collar and opposite said adjustment knob, said clamp selectively securable to said flexible member.

5. The floor mounted resistance exerciser, according to claim 4, wherein said flexible member is a steel spring.

6. The floor mounted resistance exerciser, according to claim 4, wherein said base has a plurality of holes for receiving fasteners to secure said base to the floor.

7. The floor mounted resistance exerciser, according to claim 2, further comprising:

a knuckle system interposed between said rotating resistance exerciser and said flexible member, wherein said knuckle system is pivotable to an angled position between 0 and 90 degrees.

8. A floor mounted resistance exerciser, comprising:

a base mountable to a stationary member;

a tubular support member extending outwardly from said base;

a rotating resistance exerciser; and a flexible member telescopically received and selectively secured at one end to said tubular support member and telescopically received and selectively secured at the opposite end to said rotating exerciser, which is spaced apart from said tubular support member, wherein said rotating resistance exerciser rotates around said flexible member.

* * * * *